US010657932B1

(12) United States Patent
Madocks

(10) Patent No.: US 10,657,932 B1
(45) Date of Patent: May 19, 2020

(54) TUNING DEVICE FOR STRINGED MUSICAL INSTRUMENT

(71) Applicant: John Eric Madocks, Shelburne Falls, MA (US)

(72) Inventor: John Eric Madocks, Shelburne Falls, MA (US)

( * ) Notice: Subject to any disclaimer, the term of this patent is extended or adjusted under 35 U.S.C. 154(b) by 0 days.

(21) Appl. No.: 16/379,926

(22) Filed: Apr. 10, 2019

(51) Int. Cl.
*G10D 3/14* (2020.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS 4,426,907 A * 1/1984 Scholz ..... G10G 7/02 318/6
4,693,160 A * 9/1987 Hoshino ..... G10D 3/14 84/267
4,779,506 A * 10/1988 Takeuti ..... G10D 3/14 84/267
8,536,430 B2 * 9/2013 McCabe ..... G10D 3/14 84/312 R
8,952,231 B1 * 2/2015 Gonzalez ..... G10D 1/085 84/297 R

* cited by examiner

*Primary Examiner* — Robert W Horn

(57) ABSTRACT

A compact string tensioning tuning assembly for a stringed instrument comprising two or more worm gear tuners where the tuner worm gears are in axial alignment and individual tuners are rotationally positioned around the worm gear axis such that the tuner knobs are separated from each other and finger access to individual tuner knobs is improved.

4 Claims, 5 Drawing Sheets

TUNING DEVICE FOR STRINGED MUSICAL INSTRUMENT

This application claims benefit of provisional patent application No. 62/657,298 entitled "Tuning machine assembly for stringed instrument" filed Apr. 13, 2018.

TECHNICAL FIELD

The present invention relates to devices for adjusting the tension of strings in musical instruments, particularly guitars.

BACKGROUND

So long as stringed instruments have existed there has been a need to adjust the tension of the strings. One familiar practice for adjusting the string tension has been to mount rotatable winch-like devices at the end of the neck so that each string may be individually adjusted by turning a knob. These individual tensioning devices are often referred to as tuning machines or tuners. Of importance to musicians is such string tensioning tuners be easily and individually accessible to the fingers because of a need and desire to often adjust and readjust the tension of strings.

Stringed instruments such as guitars are often carried on airplanes by musicians. Thus it is of interest to many that these instruments be compact. However, while compactness is desired, the need to easily grasp and turn each tuner knob must be maintained. Various U.S. patents reveal the efforts of prior inventors to provide more compact tuner solutions. In 1904 Henzi in U.S. Pat. No. 778,129 offset worm gear tuners to increase the density of strings in zithers. In U.S. Pat. No. 2,216,601, Nelson spaced the tuners close together and offset the knobs in a lap guitar. This made individual knobs more accessible and knobs could be larger to reduce the turning forces needed. In U.S. Pat. No. 2,523,963, Mitchell fanned out the tuners to increase the space between the knobs. Mitchell shows what today is called a headless guitar with the tuners mounted in the guitar body, behind the bridge, and the guitar head stock is reduced in size. Steinberger in U.S. Pat. No. 4,608,904 uses a screw thread string tensioning system rather than worm gears tuners in a headless guitar. The '904 threaded tuners are mounted in a row behind the bridge in line with the strings. In Middleton, US2017/0193973A1, worm gear tuners are stacked in several compact configurations.

A common compact or travel guitar is a headless guitar with the string tension adjusting tuners mounted behind the bridge in the guitar body. Locating the tuners in the body is not ideal because the same hand used to pluck a string must then also adjust string tension. Also, the body mounted tuners can have small, closely spaced adjustment knobs that are difficult to access. These detriments are validated by how few musicians use these travel guitars for performing on stage. The ideal compact travel guitar would be shorter than a standard electric guitar and yet be easily and stably tuned and have equal or better tone quality than a standard electric guitar.

SUMMARY

An object of the present invention is to provide a compact string tensioning tuning assembly that can be fitted to the head of a stringed instrument where the tuning keys are individually easily graspable. In accordance with the present invention, a tuning assembly is provided comprising two or more worm gear tuners where the tuner worm gears are in axial alignment and individual tuners are rotationally positioned around the worm gear axis such that the tuner knobs are separated from each other and finger access to individual tuner knobs is improved. In embodiments the inventive tuner assembly can be applied to a guitar and the tuners can be rotationally set to three or more different positions to further improve individual tuner knob access.

The foregoing and other objects, features and advantages of the present invention will become more apparent from the following description of preferred embodiments and accompanying drawings.

DESCRIPTION

Figure 1:
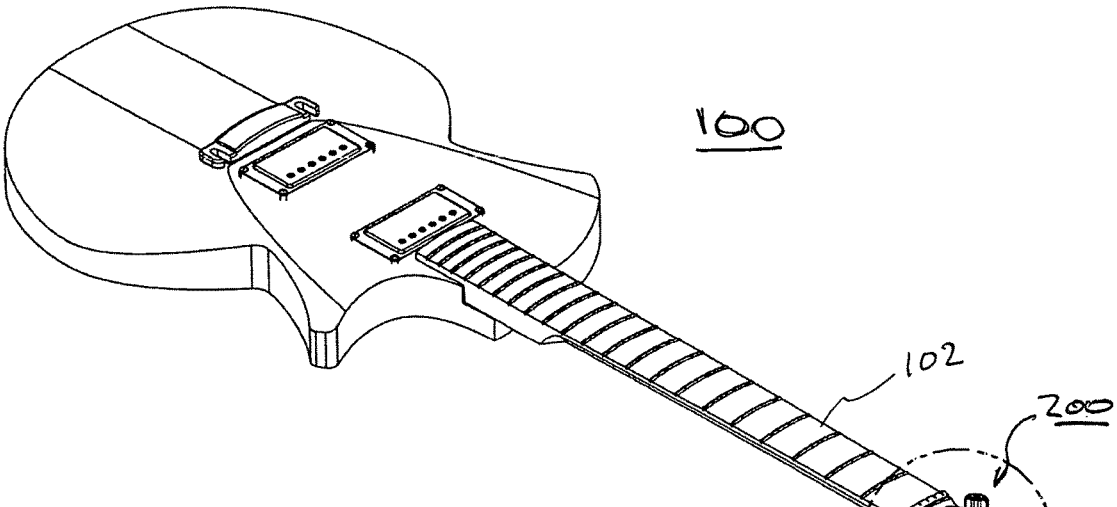
FIG. 1 is a perspective view of an electric guitar having a tuning assembly at the head.
Figure 1A:
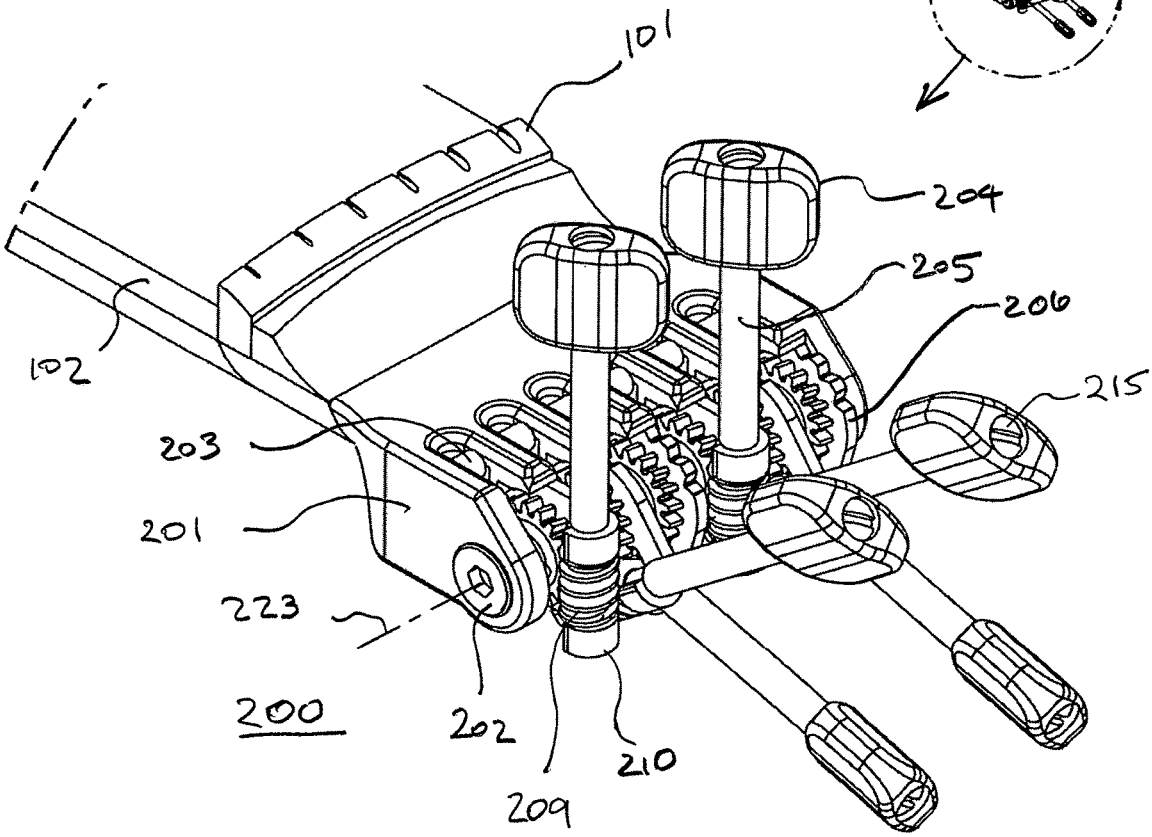
FIG. 1*a* is a perspective view of a tuning assembly of the guitar in FIG. 1.
Figure 7:
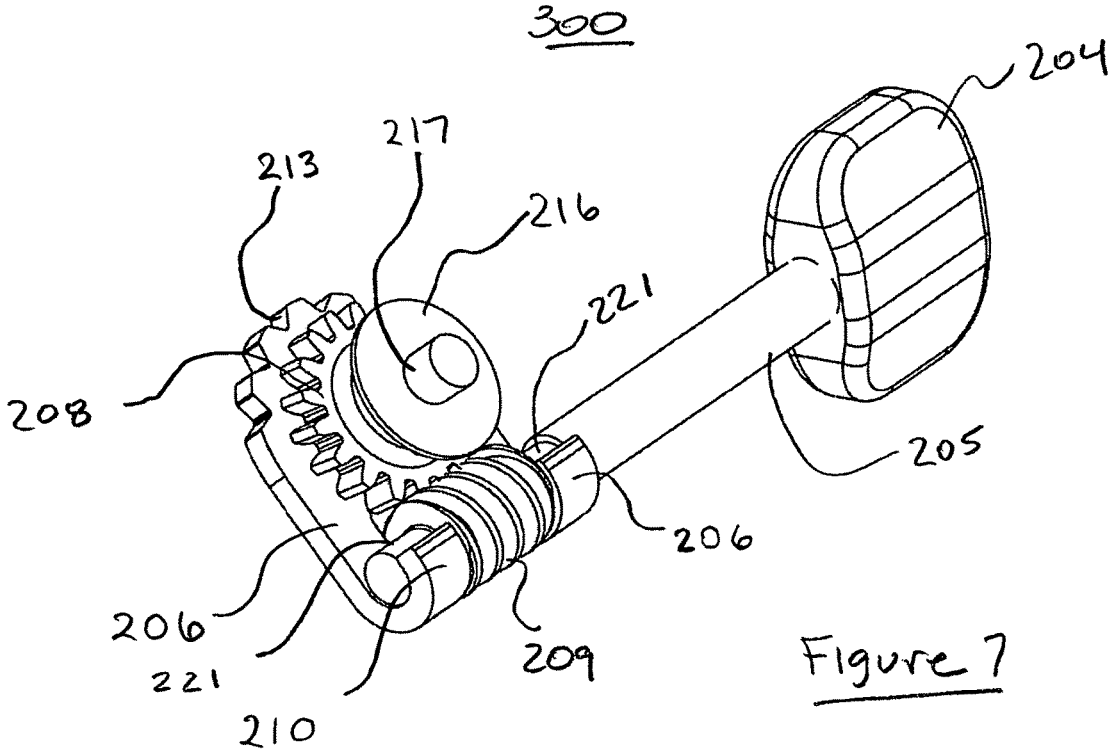
FIG. 7 is a perspective view of tuner that is part of the tuning assembly of FIG. 2*a*.
Figure 8:
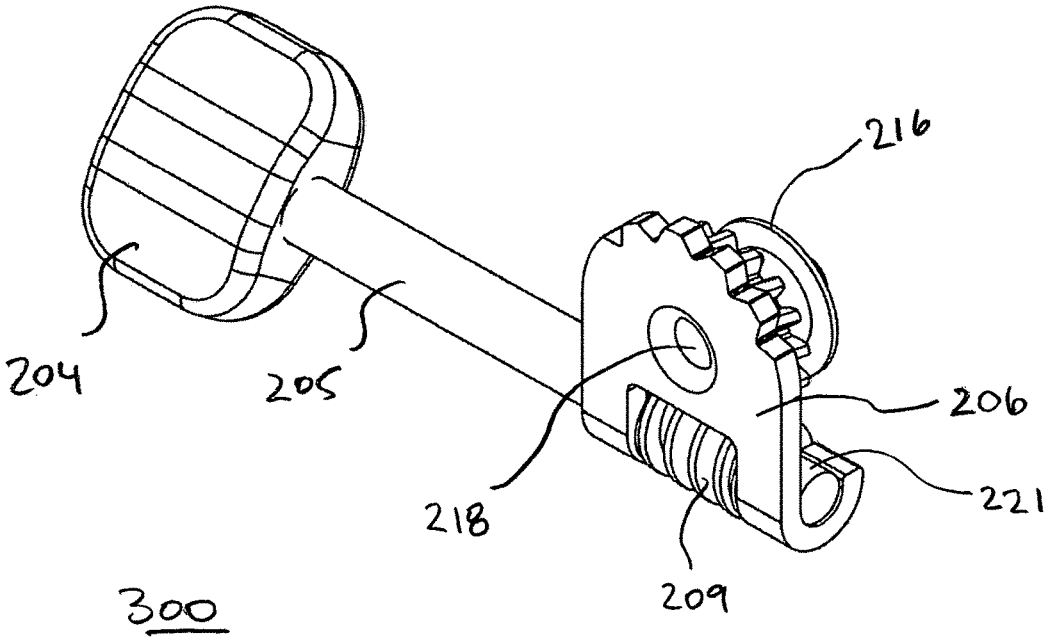
FIG. 8 is another perspective view of tuner that is part of the tuning assembly of FIG. 2*a*.

FIGS. 1 and 1*a* show the inventive tuning assembly 200 mounted to the end of guitar neck 102 of electric guitar 100. Tuning assembly 200 replaces the conventional longer head stock while still allowing preferable guitar head tuning of the guitar strings (strings not shown for clarity). Tuning assembly 200 is compact and reduces the overall length of the guitar by several inches. While being compact, the inventive tuning assembly does not sacrifice of ease of use or tone quality. The inventive tuning assembly 200 is composed of aluminum housing 201 that is securely fastened to guitar neck 102 just after guitar nut 101. Housing 201 holds a line of worm gear tuning machines (tuners) 300 (also see FIGS. 7 and 8). In the case of a six-string guitar, six tuners 300 share a cylindrical axis 223 in housing 201. End cap 202 and End cap 216 (FIG. 5) hold the 6 tuners 300 together, end to end in housing 201. End caps 202 and 216 can be stainless steel or aluminum Referring to FIGS. 7 and 8, each individual worm gear tuning machine 300 includes a case 206, a worm gear 208 and a worm 209. Worm 209 includes bearing surfaces 221 and shaft 205. The case 206 is stainless steel or aluminum. Worm gear 208 is bronze and worm 209 is stainless steel. A knob 204 mounts on the end of shaft 205 and is secured by screw 215. Knob 204 may be wood, metal, plastic or other suitable material. Worm 209 bearing surfaces 221 rest in case 206 support features 210. Worm 209 also is in contact with worm gear 208.

Figure 2:
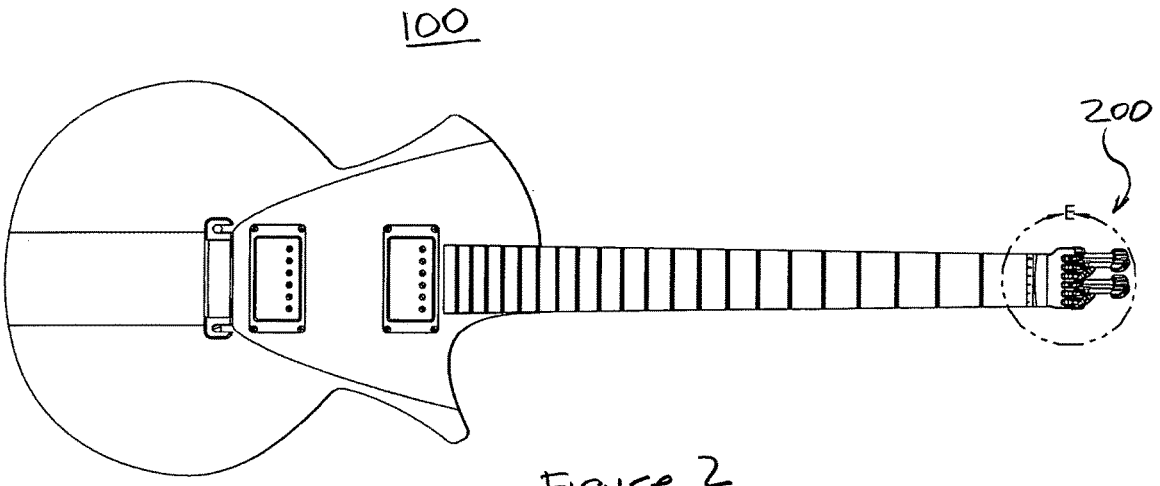
FIG. 2 is a front view of the guitar shown in FIG. 1.
Figure 2A:
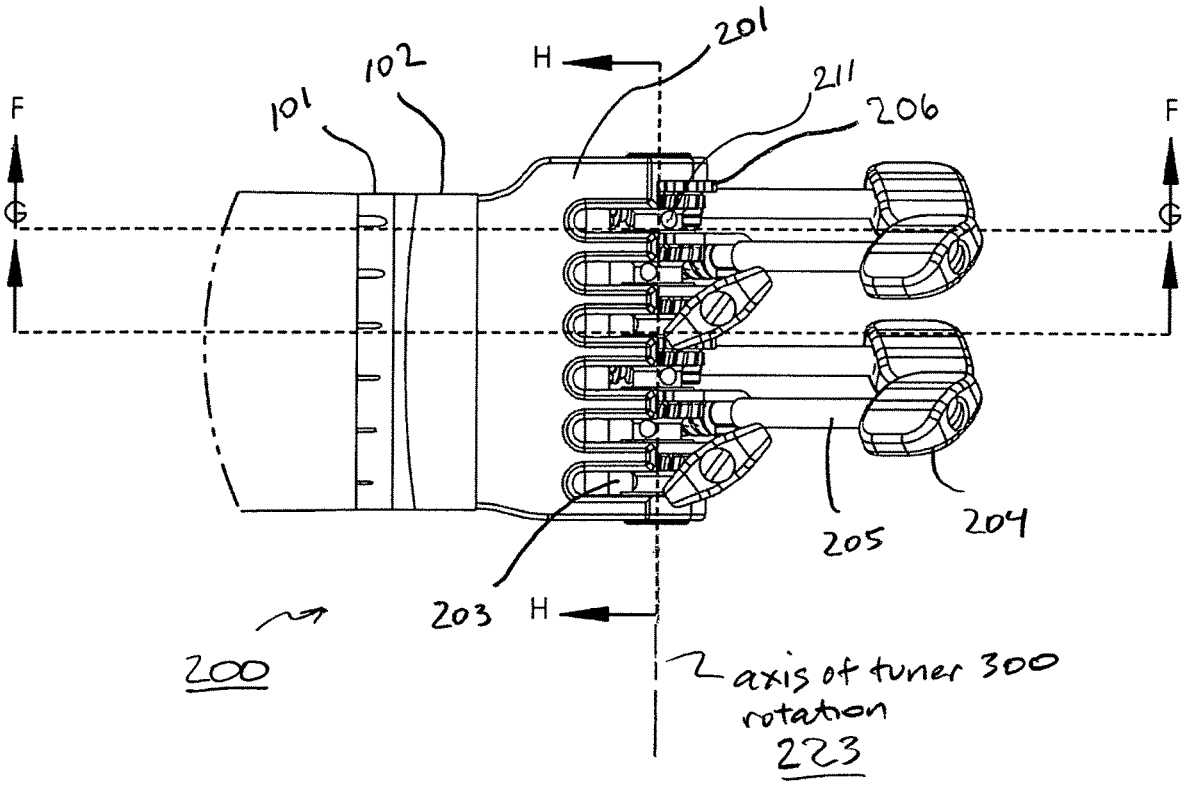
FIG. 2*a* is a more detailed front view of the head portion and tuning assembly of the guitar shown in FIG. 1 and FIG. 2.

FIGS. 2 and 2*a* show the front view of electric guitar 100 with tuning assembly 200. FIG. 2*a* is sectioned for more detailed views. Section F-F is FIG. 3, Section G-G is FIG. 4 and Section H-H is FIG. 5.

Figure 3:
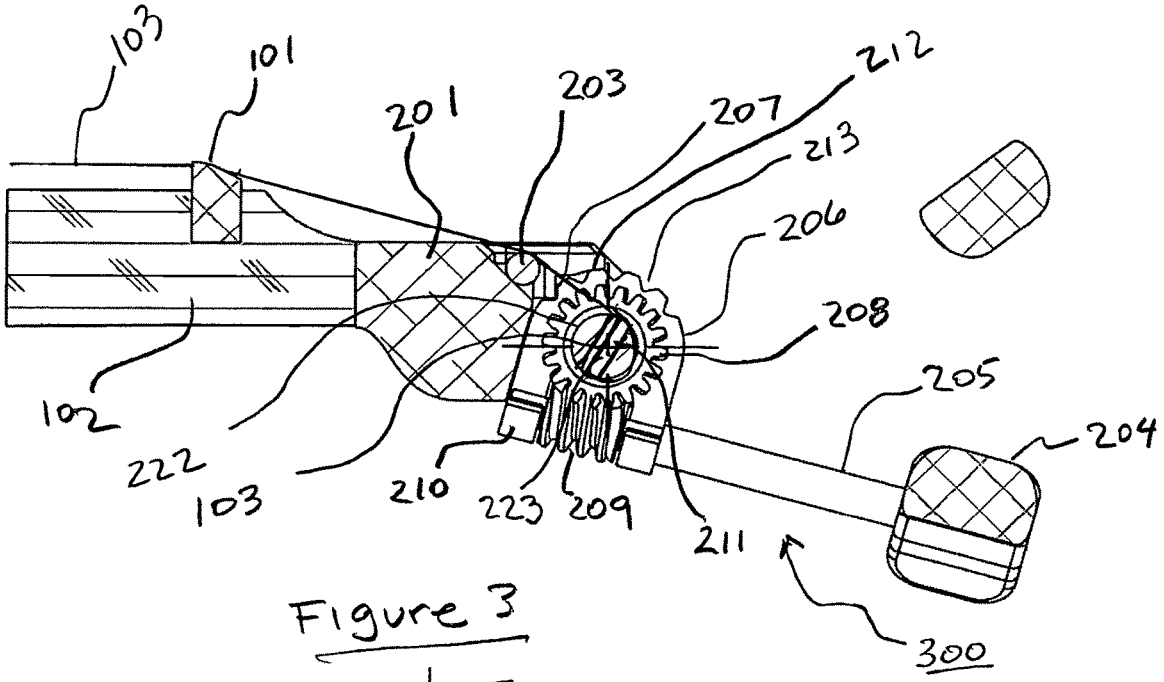
FIG. 3 is a side view cross section of the tuning assembly shown in FIG. 2*a* (Section view F-F).
Figure 4:
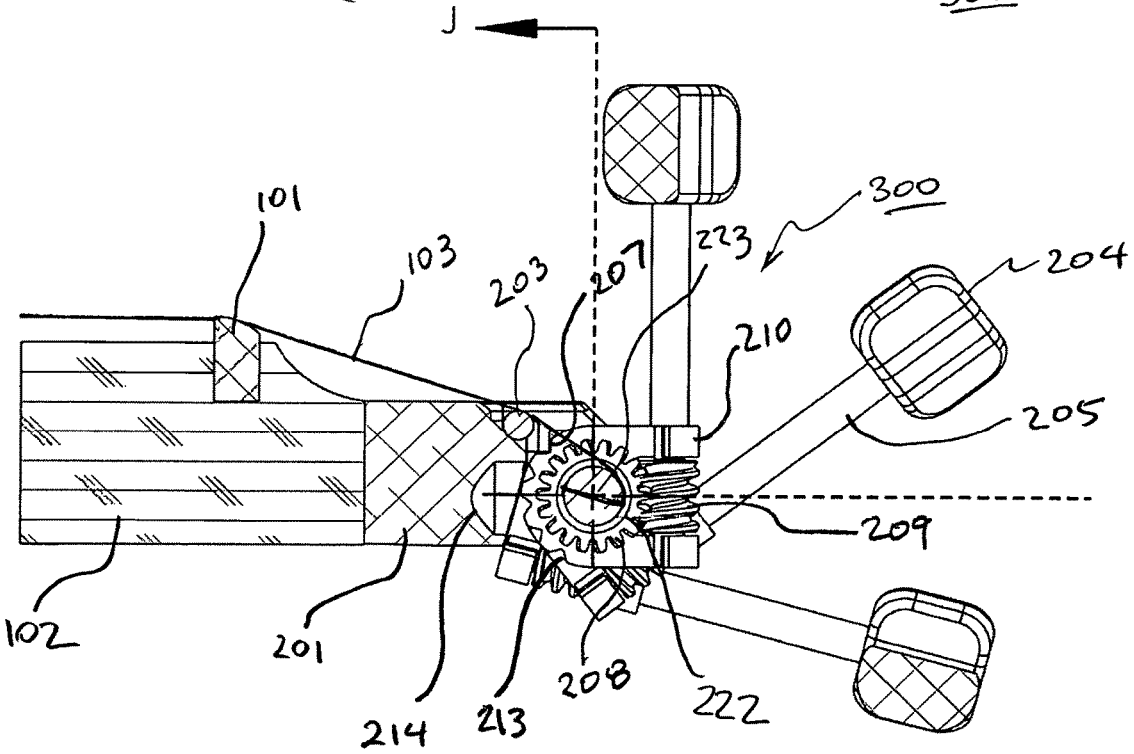
FIG. 4 is another side view cross section of the tuning assembly shown in FIG. 2*a* (Section view G-G).

FIG. 3 and FIG. 4 show section views of tuning assembly 200, Section views F-F and G-G respectively from FIG. 2*a*. These views show how single worm gear tuners 300 are rotatably positioned and secured around axis 223 to increase access to individual string tuning knobs 204. As can be seen in FIGS. 1 and 1*a*, the inventive tuners 300 are individually rotatably positioned to allow easy access for tuning each string. If all worm gear tuner shafts 205 were aligned in a row, there would be very little finger room to adjust individual string tensions. In the inventive tuning assembly, individual tuners 300 can be rotatably positioned during assembly to spread apart knobs 204 and greatly improve access to tune individual strings. Also, the length of tuner shafts 205 can be varied to allow more or less spread between knobs 204.

To position worm gear tuners 300 along axis 223, 6 tuners are organized into a stack and are inserted into housing 201. Before end caps 202 and 216 secure the tuners in housing 201, each tuner 300 is rotated into the desired position relative to housing 201. Each tuner case 206 has 5 notches 213. Each tuner is rotated such that one of the 5 notches 213 engages with case positioning feature 207. A variety of positions can be set up and this is readily done by the musician to personalize his instrument. One such arrangement is shown in the FIGS. (see FIGS. 1 and 1*a*). Once the tuners 300 are positioned according to preference, end caps 202 and 211 are threaded in and tightened. The tuning assembly is now ready for strings to be added and tensioned.

FIGS. 3 and 4 show string 103 proceeding from the guitar 100 neck 102 to the nut 101 and then down to tuning assembly 200. At assembly 200, string 103 wraps over string bar 203 and then onto an individual worm gear tuning machine 300 surface 222 (see FIG. 6). String 103 is passed through string hole 211 and may be wrapped to secure it in place. Securing strings on tuner gear shafts is well known. The inventor has found that passing the string through hole 211, wrapping it 180 degrees around and then passing it through hole 211 again is an easy and secure method of fixing the string. Once string 103 is fixed on worm gear string surface 222, string tensioning and pitch tuning are done similar to standard worm gear type tuning machines.

When string 103 is tensioned, worm gear tuner 300 is drawn toward string bar 203. Also, the pull of string 103 tries to rotate tuner 300 about mounting axis 223. The string tension force pulling tuner 300 toward string bar 203 is resisted as tuner case 206 contacts both the positioning feature 207 and surface 212 of housing 201. The rotational moment on tuner 300 is resisted by the engagement of housing feature 207 and case notch 213. In this way, each tuner assembly 300 is individually and securely held independent of the other string tuner assemblies 300. In this way the tuning of one string does not change the tension of adjacent strings.

Figure 5:
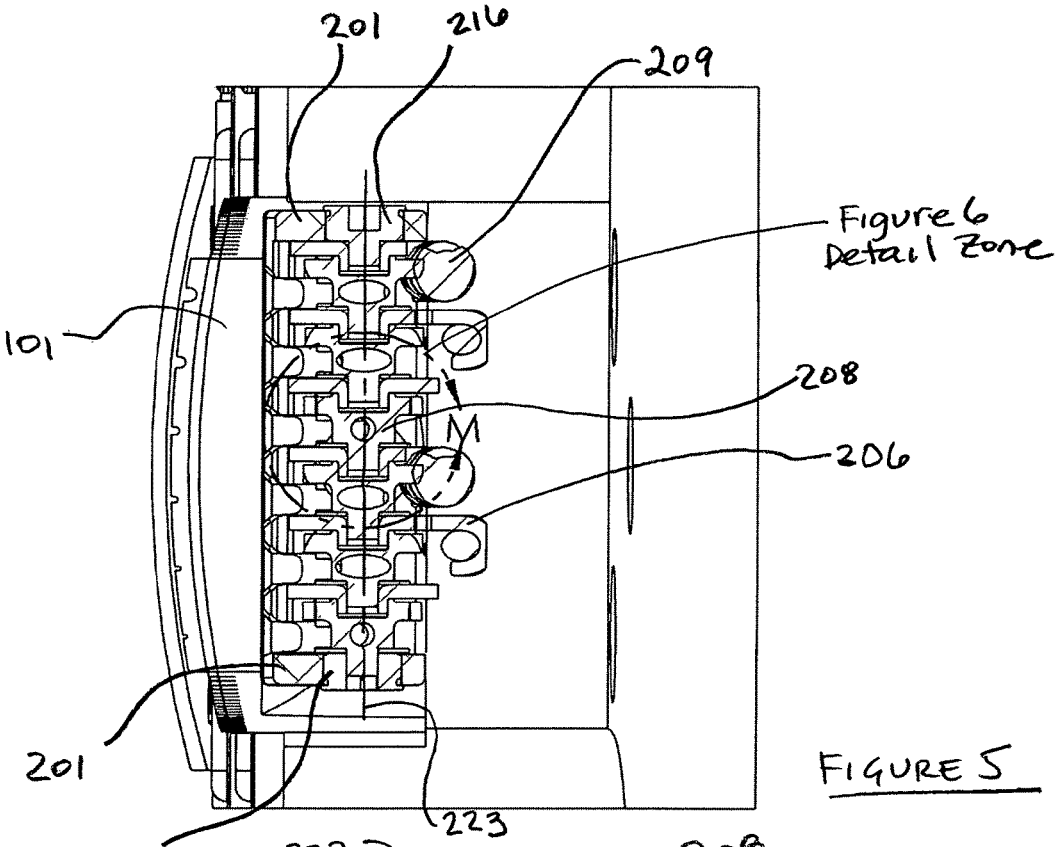
FIG. 5 is a section view H-H of tuning assembly 200
Figure 6:
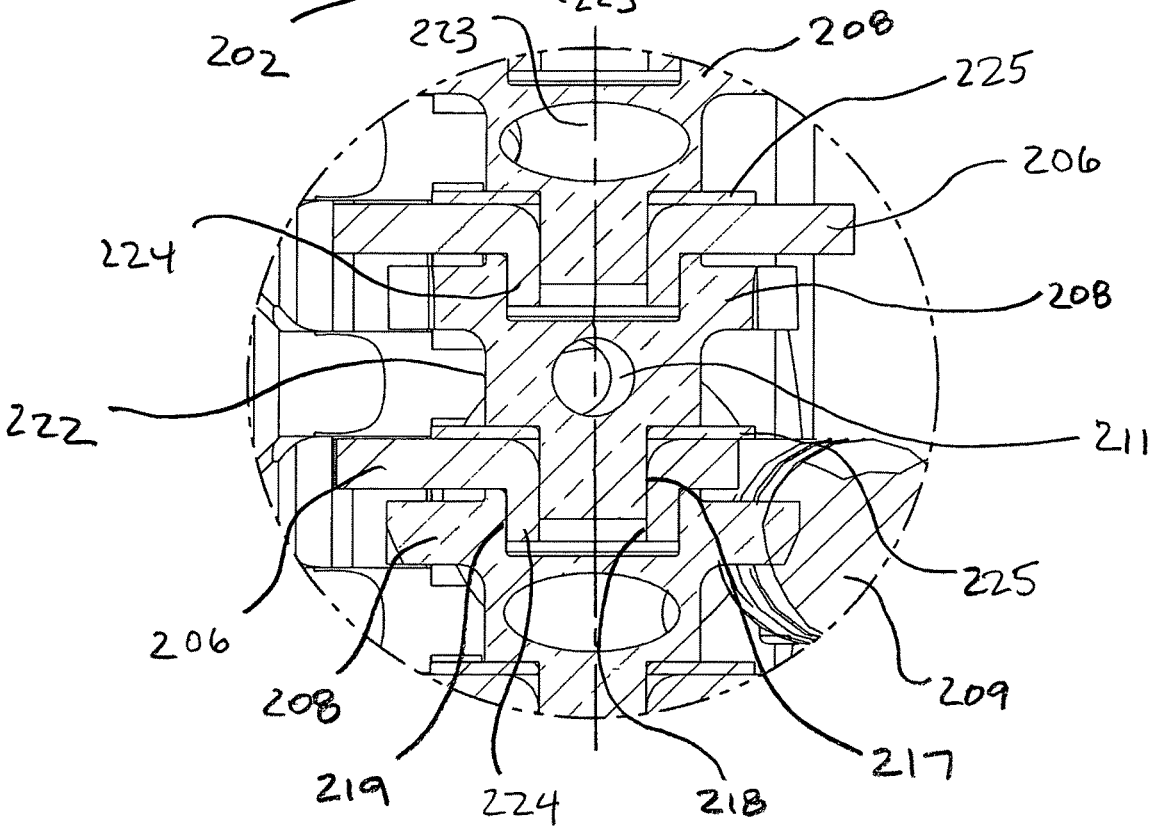
FIG. 6 is a detail from section view H-H of tuning assembly 200

FIG. 5 shows a section view of tuner assembly 200 mounted on neck 102 (Section H-H from FIG. 2*a*). FIG. 6 shows a detail section view from FIG. 5 of worm gear tuners 300 stacked in assembly 200. These views show how each individual worm gear tuner 300 is held in axial alignment on axis 223. Each worm gear 208 has a concave bearing surface 219 and a shaft 217. The concave bearing surface 219 fits on case 206 formed protrusion 224. Worm shaft 217 fits into case protrusion 224 internal diameter 218. washer 225 separates worm gear 208 from case 206. In this way, individual tuner machines 300 are stacked one next to the other to make up the needed number of strings for the instrument. As can be readily seen, this can be any number from 2 to 8 or more. Note that even though the tuner worm gears 208 are in axial alignment and overlap each other on the axis 223, they don't contact each other. In this way adjusting string tension of one string, turning one worm gear, does not apply a turning force to an adjacent worm gear and its string.

The inventive method can be applied to a wide range of musical stringed instruments both acoustical and electric with any number of strings. Also, tuner 300 can have more or less notches 207 so case 206 and therefore tuner assembly 300 can have more or less rotational position locations. (The FIG's show an embodiment with 5 locational notches so each tuner 300 can have any one of 5 rotational positions along the central axis 223.)

The inventive method can be applied at either end of the stringed instrument. In the embodiment's shown, the inventive tuning machine assembly is located at the head of the guitar. It can be readily imagined that the inventive apparatus can alternatively be positioned at the bridge end.

The invention claimed is:

1. A tuning assembly for tensioning strings of a stringed instrument comprising 2 or more worm gear tuners (300)
wherein the worm gears (208) are in axial alignment
and, wherein said tuners are individually rotationally positioned on said worm gear axis such that finger access to the tuner keys (204) is improved.

2. A tuning assembly according to claim 1 wherein said tuning assembly is mounted in the head stock of the instrument.

3. A tuning assembly according to claim 1 including at least six (6) worm gear tuners wherein the worm gears of the six tuning assemblies are in axial alignment.

4. A tuning assembly according to claim 3 wherein said tuners (300) are rotatably positioned such that said six tuners have at least three different angular positions along said worm gear axis.

* * * * *